United States Patent [19]

Hanni et al.

[11] Patent Number: 4,785,745

[45] Date of Patent: Nov. 22, 1988

[54] METHOD FOR WASTE TREATMENT

[75] Inventors: Jorma Hanni, Espoo; Mauri T. Rantanen, Vihti; Matti Vattulainen; Syrjämäki, both of Riihimäki, all of Finland

[73] Assignees: Outokumpu Oy, Helsinki; Ekokem Oy Ab, Riihimaki, both of Finland

[21] Appl. No.: 64,307

[22] PCT Filed: Oct. 3, 1986

[86] PCT No.: PCT/FI86/00107

§ 371 Date: May 26, 1987

§ 102(e) Date: May 26, 1987

[87] PCT Pub. No.: WO87/02119

PCT Pub. Date: Apr. 9, 1987

[30] Foreign Application Priority Data

Oct. 3, 1985 [FI] Finland ..... 853834

[51] Int. Cl.[4] ..... F23G 7/04

[52] U.S. Cl. ..... 110/346; 110/238

[58] Field of Search ..... 110/237, 236, 346, 238

[56] References Cited

U.S. PATENT DOCUMENTS

| | | | |
|---|---|---|---|
| 4,121,524 | 10/1978 | Voelskow et al. | 110/346 X |
| 4,136,624 | 1/1979 | Kato et al. | 110/236 |
| 4,332,626 | 6/1982 | Hood et al. | 110/236 X |
| 4,419,943 | 12/1983 | Faurholdt | 110/237 |

*Primary Examiner*—Edward G. Favors

[57] ABSTRACT

A method for treating hazardous waste contained in barrels (1), in which method the barrels (1) are cut up and/or crushed in a shearing device (9) so that the created waste mass can be pumped into a kiln furnace (4) by means of a paste pump.

21 Claims, 1 Drawing Sheet

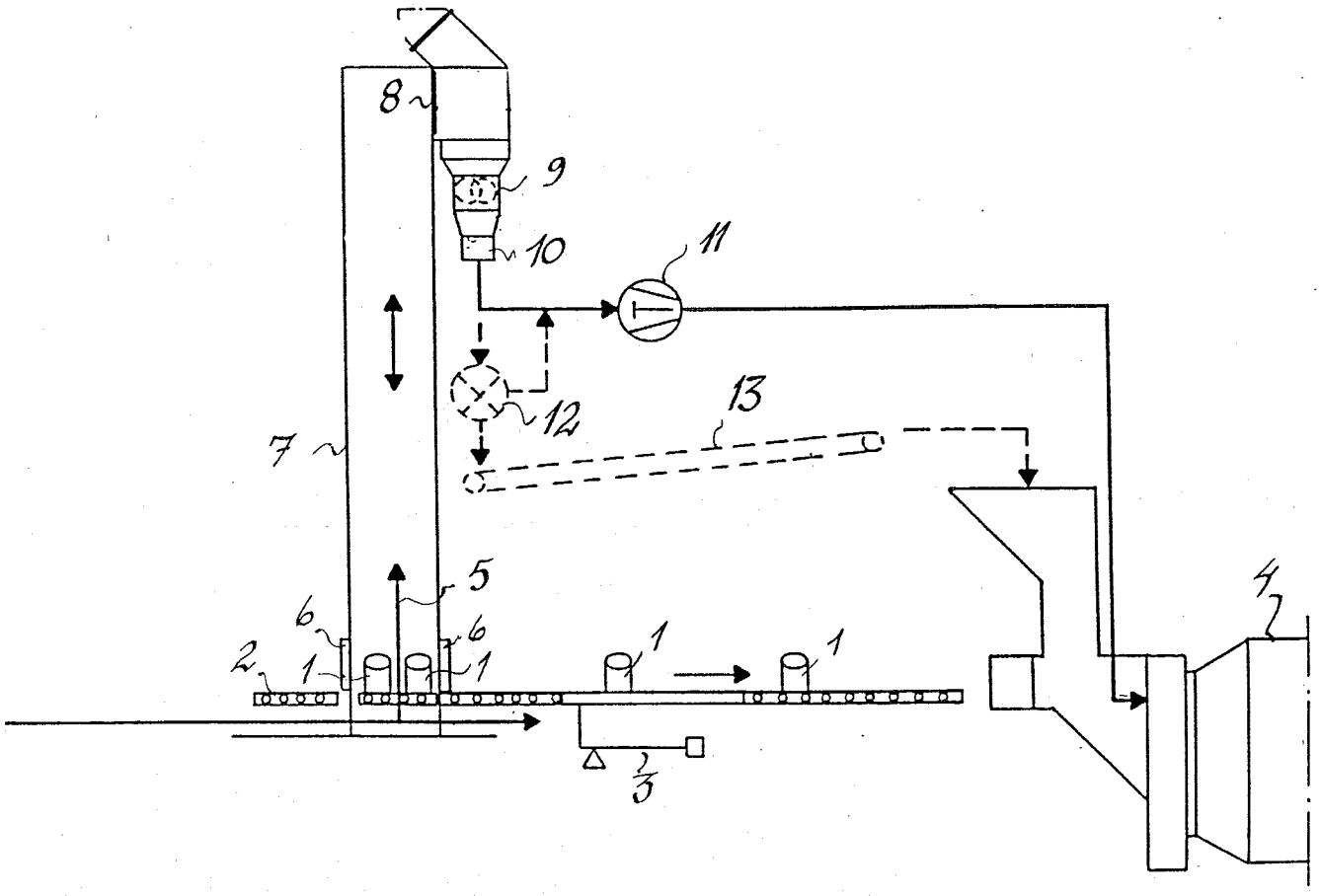
4
13
11
1
1
3
9
10
12
5
6
1
8
7
6
1
2

METHOD FOR WASTE TREATMENT

The present invention relates to a method for treating waste, particularly the so-called hazardous waste. More particularly, the invention relates to the treatment of waste contained in bulk receptacles such as barrels and other such waste containers. The waste contained in barrels is transported in a charging conveyor. The desired amount of waste is measured by employing for example a balance, and the waste is burned in a suitable furnace, for instance a kiln furnace.

In the prior art methods for treating waste, the procedure may be for example as follows. The barrels containing waste are transported, by means of a conveyor or equivalent, to an opening checkpoint. Here each vessel is opened, and the contents are examined at least ocularly. Hazardous waste may contain easily evaporated, harmful liquids and/or gases, and therefore the vessels are generally covered by a plastic hood. Before the covering, it may be necessary to reduce the waste contained in the barrel roughly by half. This is due to the fact that the amount of waste contained for instance in a 200 liter barrel may create a powerful pressure impulse when entering the furnace. The pressure impulse easily brings about a dangerous gas leak even if there are no mechanical damages. Moreover, it has been observed that the emptying and burning of waste containers is not always carried out successfully. Every once in a while it may happen that a barrel complete with waste manages to pass through the burning chamber practically unburnt. Furthermore, it is pointed out that the capacity of a kiln furnace remains remarkably poor in the above described prior art method.

In order to avoid the aforementioned drawbacks, the present invention is characterized by the novel features mainly enlisted in the claim 1.

Among the advantages of the present invention, as compared with the prior art methods, the following can be distinguished. By means of the invention, the capacity of a waste disposal plant is multiplied. Irrespective of this, the charging of waste into the kiln furnace can be regulated accurately and steplessly. The danger of possible pressure impulses is essentially reduced, and in practice almost completely eliminated. Thus also harmful gas discharges into the surrounding factory facilities or nature can be more effectively prevented. At the same time, the burning/processing time of the waste is shortened. By aid of the invention, process can be automated in an essentially easier fashion. Consequently, the amount of required personnel is smaller than with the prior art methods. The homogenization of the feed is likewise remarkably easier than in the conventional methods. Respectively, the cutting up of solid waste into smaller particles also means an essential improvement in the processing.

DESCRIPTION OF THE DRAWING

In the following the invention is explained in detail with reference to the appended drawing which is a schematical illustration of apparatus for carrying out a method according to the present invention.

DESCRIPTION OF PREFERRED EMBODIMENT

The hazardous waste is transported in the barrel 1 by means of the charging conveyor 2. In the prior art method, the barrels 1 are then shifted to the balance 3 and further into the kiln furnace 4. On the side of this charging path, there is installed the transversal conveyor 5 according to the invention. The transversal conveyor 5 may be for instance an elevator which moves within the gas-sealed liftshaft 7 closed by the closing traps 6. The running path can be chosen either directly into the kiln furnace or via the transversal conveyor 5, the centre of operations being the control unit which is not illustrated in the drawing.

At the top end of the transversal conveyor 5, the barrels are disposed, through the fire door 8, into the shearing device 9. The shearing device 9 comprises two parallel shafts operated by intermediation of a gear assembly. On the shafts there are attached single-dented shearing plates which crush and shear the barrels.

Fire precautions in the shearing device are carried out so that an inert gas atmosphere is maintained therein. The ignition can be prevented beforehand by employing a slight nitrogen gas feed.

The waste from the barrels crushed in the shearing device 9 is conducted into the compensation basin 10. The compensation basin ensures an uninterrupted feed into the furnace. The barrel feed into the shearing device can be adjusted by observing the amount of material contained in the compensation basin.

From the compensation basin 10, the crushed contents of the barrel and/or barrel lumps are fed, by means of the paste pump 11, further into the kiln furnace 4. The paste pump 11 is a double-piston pump with a shearing clamping device. Thus the clamping device cuts up metal scrap, even studs.

When desired, for instance steel scrap can be separated by means of the iron separator 12 and transported, by a specific conveyor 13, into the kiln furnace as well. Alternatively, also the metal scrap can be shifted directly into a storage bunker to wait for a separate further treatment.

In the above description the invention is explained with reference to one preferred embodiment only. It is naturally obvious that the invention is not exclusively limited to the above described example, but many modifications therein are possible within the scope of the following claims. Thus for instance fire precautions can also be carried out by applying steam blasting in the shearing device. Instead of the shearing device described above, it is also possible to use an effective press which presses the barrels or other such solid particles into a space as small as possible. The essential point is that the packages, whether barrels or other corresponding items, are transformed into such a form that the waste can be treated by pumping in a paste pump.

We claim:

1. A method for treating waste contained in vessels such as barrels and the like, particularly hazardous waste, the said method including transporting the vessels (1) containing the waste by means of a charging conveyor (2), and burning the waste in a furnace, characterized in that the vessels (1) are shifted from the charging conveyor (2) into a shearing device (9), where the vessels are cut up and/or pressed to crush so that the waste can be treated with a paste pump (11), metal is separated from the waste before the waste is pumped into the kiln furnace (4) by means of the paste pump (11), and the separated metal is transported, by means of a band conveyor (13), into the same furnace as the waste proper.

2. The method of claim 1, characterized in that before pumping, the waste mass is conducted into a compensation basin (10).

3. A method for treating waste contained in vessels such as barrels and the like, particularly the hazardous waste, the said method including transporting the vessels (1) containing the waste by means of a charging conveyor (2), and burning the waste in a furnace, characterized in that the vessels (1) are shifted from the charging conveyor (2) into a shearing device (9), where the vessels are cut up and/or pressed to crush so that the waste can be treated with a so-called paste pump (11), and, in order to eliminate the danger of fire, an inert gas atmosphere is maintained within the shearing device (9).

4. The method of claim 3, characterized in that the employed inert gas is nitrogen.

5. A method for treating waste material, comprising delivering the waste material to a treatment location in a closed metal vessel, subjecting the vessel to a shearing operation, whereby the vessel is broken or crushed and the contents of the vessel are released, and conveying released waste material and parts of the broken or crushed vessel into a furnace.

6. A method according to claim 5, wherein the waste material includes metal and the method comprises separating metallic waste material from the non-metallic waste material and conveying the non-metallic waste material into the furnace.

7. A method according to claim 6, comprising conveying the separated metallic waste material into the furnace separately from the non-metallic waste material.

8. A method according to claim 5, comprising accumulating waste material in a compensation basin before conveying the waste material into the furnace.

9. A method according to claim 5, comprising carrying out the shearing operating under an inert gas atmosphere.

10. A method according to claim 9, comprising carrying out the shearing operation under an atmosphere of nitrogen.

11. A method for treating waste material that includes metal, comprising delivering the waste material to a treatment location in a closed vessel, subjecting the vessel to a shearing operation, whereby the vessel is broken or crushed and the contents of the vessel are released, separating metallic waste material from the non-metallic waste material, conveying the non-metallic waste material into the furnace, and conveying the separated metallic waste material into the furnace separately from the non-metallic waste material.

12. A method according to claim 11, comprising conveying the parts of the broken or crushed vessel into the furnace.

13. A method according to claim 11, wherein the vessel is a metal vessel and the method comprises conveying parts of the broken or crushed vessel into the furnace.

14. A method according to claim 11, comprising accumulating waste material in a compensation basin before conveying the waste material into the furnace.

15. A method according to claim 11, comprising carrying out the shearing operating under an inert gas atmosphere.

16. A method according to claim 15, comprising carrying out the shearing operation under an atmosphere of nitrogen.

17. A method for treating waste material, comprising delivering the waste material to a treatment location in a closed vessel, subjecting the vessel to a shearing operation, whereby the vessel is broken or crushed and the contents of the vessel are released, the shearing operation being carried out under an inert gas atmosphere, and conveying released waste material into a furnace.

18. A method according to claim 17, comprising conveying the parts of the broken or crushed vessel into the furnace with the released waste material.

19. A method according to claim 17, wherein the waste material includes metal and the method comprises separating metallic waste material from the non-metallic waste material and conveying the non-metallic waste material into the furnace.

20. A method according to claim 17, comprising accumulating waste material in a compensation basin before conveying the waste material into the furnace.

21. A method according to claim 17, comprising carrying out the shearing operation under an atmosphere of nitrogen.

* * * * *